US011112723B1

(12) United States Patent
Iguchi et al.

(10) Patent No.: US 11,112,723 B1
(45) Date of Patent: Sep. 7, 2021

(54) IMAGE FORMING APPARATUS AND CONTROL METHOD FOR COLLECTING WASTE TONER IN A WASTE TONER COLLECTION CONTAINER

(71) Applicant: TOSHIBA TEC KABUSHIKI KAISHA, Tokyo (JP)

(72) Inventors: Ken Iguchi, Numazu Shizuoka (JP); Kazuhiko Kikuchi, Yokohama Kanagawa (JP); Tadashi Sugiyama, Numazu Shizuoka (JP); Tokihiko Ise, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/094,911

(22) Filed: Nov. 11, 2020

(30) Foreign Application Priority Data

Mar. 25, 2020 (JP) ..... JP2020-054221

(51) Int. Cl.
*G03G 21/10* (2006.01)
*G03G 15/08* (2006.01)
*G03G 21/12* (2006.01)

(52) U.S. Cl.
CPC ..... *G03G 15/0856* (2013.01); *G03G 21/12* (2013.01)

(58) Field of Classification Search
CPC ..... G03G 21/10; G03G 21/105; G03G 21/12
USPC ..... 399/35, 358, 360
See application file for complete search history.

(56) References Cited

U.S. PATENT DOCUMENTS

| | | | | |
|---|---|---|---|---|
| 7,689,156 | B2 * | 3/2010 | Shishikura | G03G 21/12 399/358 |
| 7,991,308 | B2 * | 8/2011 | Oh | G03G 21/12 399/35 |
| 2007/0196148 | A1 | 8/2007 | Shishikura | |

FOREIGN PATENT DOCUMENTS

| | | |
|---|---|---|
| JP | 2004-045451 | 2/2004 |
| JP | 2005-227730 | 8/2005 |
| JP | 2010-160319 | 7/2010 |

* cited by examiner

*Primary Examiner* — William J Royer
(74) *Attorney, Agent, or Firm* — Amin, Turocy & Watson, LLP

(57) ABSTRACT

An image forming apparatus of an embodiment includes an image forming unit, a waste toner collection container, a paddle motor, a memory unit, and a control unit. The image forming unit forms a toner image on a sheet using a toner replenished from a toner cartridge containing the toner. The waste toner collection container contains a waste toner generated in the image forming unit. The paddle motor rotates a stirring paddle provided in the waste toner collection container. The memory unit stores a coefficient for each type of toner. The control unit acquires a count value, which is a value related to a replenishment amount, corrects the count value with the coefficient corresponding to the type of toner, updates a cumulative count value with the corrected count value, and drives the paddle motor according to the updated cumulative count value.

20 Claims, 5 Drawing Sheets

IMAGE FORMING APPARATUS AND CONTROL METHOD FOR COLLECTING WASTE TONER IN A WASTE TONER COLLECTION CONTAINER

CROSS-REFERENCE TO RELATED APPLICATION

This application is based upon and claims the benefit of priority from Japanese Patent Application No. 2020-054221, filed on Mar. 25, 2020, the entire contents of which are incorporated herein by reference.

FIELD

Embodiments described herein relate generally to an image forming apparatus and a control method.

BACKGROUND

In the related art, a structure that collects a waste toner is used in an image forming apparatus using a toner. For example, a toner that remains on a drum unit when transferring from the drum unit to an intermediate transfer belt and a toner that remains on the intermediate transfer belt when transferring from the intermediate transfer belt to paper are collected as waste toners. The waste toners are stored in a waste toner collection container such as a waste toner box. The waste toner collection container is provided with a stirring paddle for the purpose of leveling the waste toners in the container. As the control of the stirring paddle, control in which the stirring paddle operates if an increase in the amount of the waste toner in the container exceeds a certain value is adopted.

However, there is a problem that the waste toner is likely to accumulate at a specific position due to factors such as an image forming apparatus operating environment. If the waste toner is accumulated at a specific position as described above, a sensor detects the accumulation regardless of the fact that there is a margin in a containing amount of the waste toner collection container, and a replacement notification is generated, which are examples of an inefficient use of the waste toner collection container in some cases.

DETAILED DESCRIPTION

To solve the problems, an aspect of an exemplary embodiment is to provide an image forming apparatus and a control method, in which a waste toner in a waste toner collection container can be efficiently collected.

An image forming apparatus of an embodiment includes an image forming unit, a waste toner collection container, a paddle motor, a memory unit, and a control unit. The image forming unit forms a toner image on a sheet using a toner replenished from a toner cartridge containing the toner. The waste toner collection container contains a waste toner generated in the image forming unit. The paddle motor rotates a stirring paddle provided in the waste toner collection container. The memory unit stores a coefficient for each type of toner. The control unit acquires a count value, which is a value related to a replenishment amount, when the image forming unit is replenished with the toner from the toner cartridge. The control unit corrects the count value with the coefficient corresponding to the type of toner. The control unit updates a cumulative count value with the corrected count value. The control unit drives the paddle motor according to the updated cumulative count value.

Figure 1:
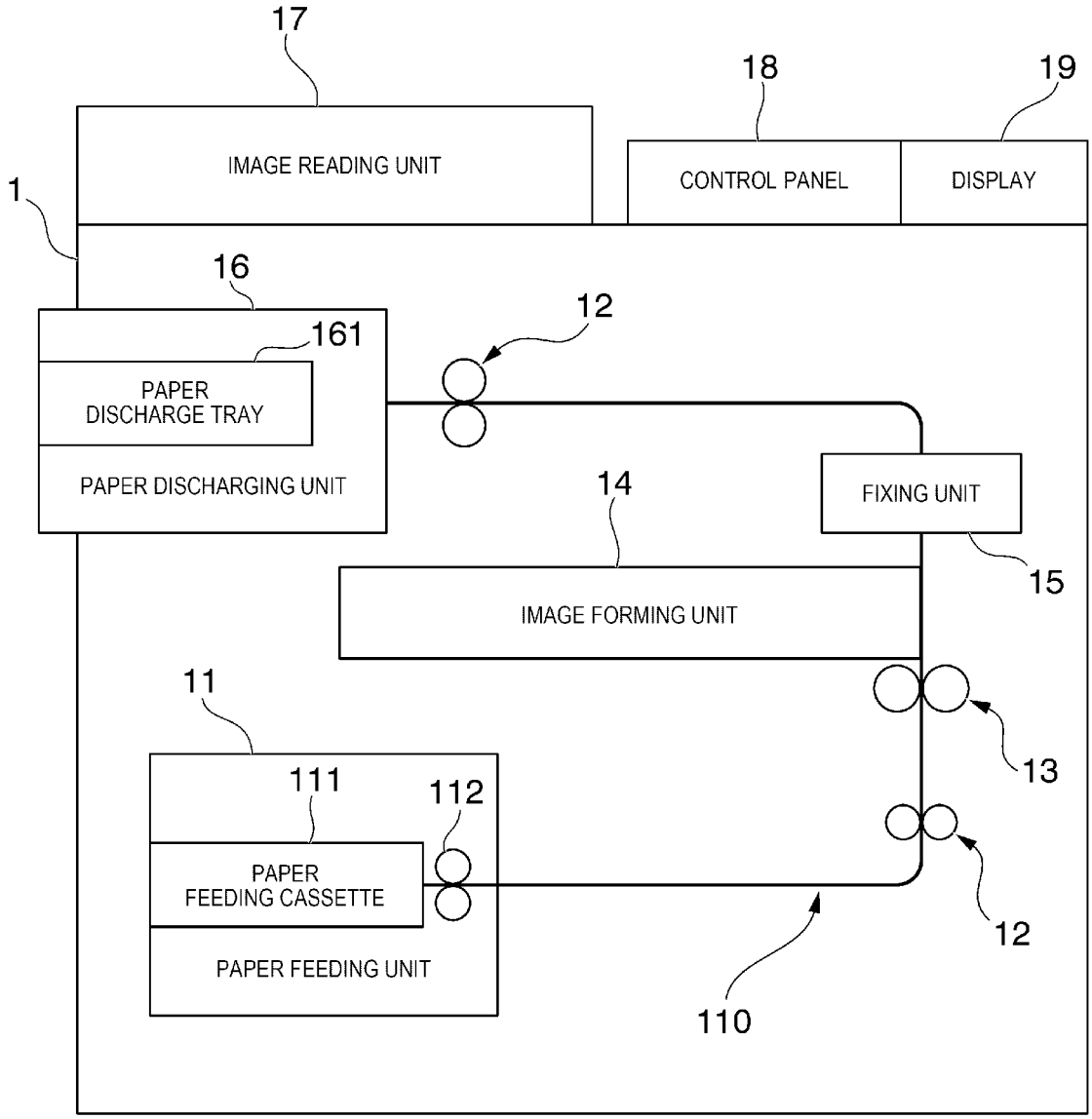
FIG. 1 is a diagram showing a configuration example of an image forming apparatus 1.
Figure 2:
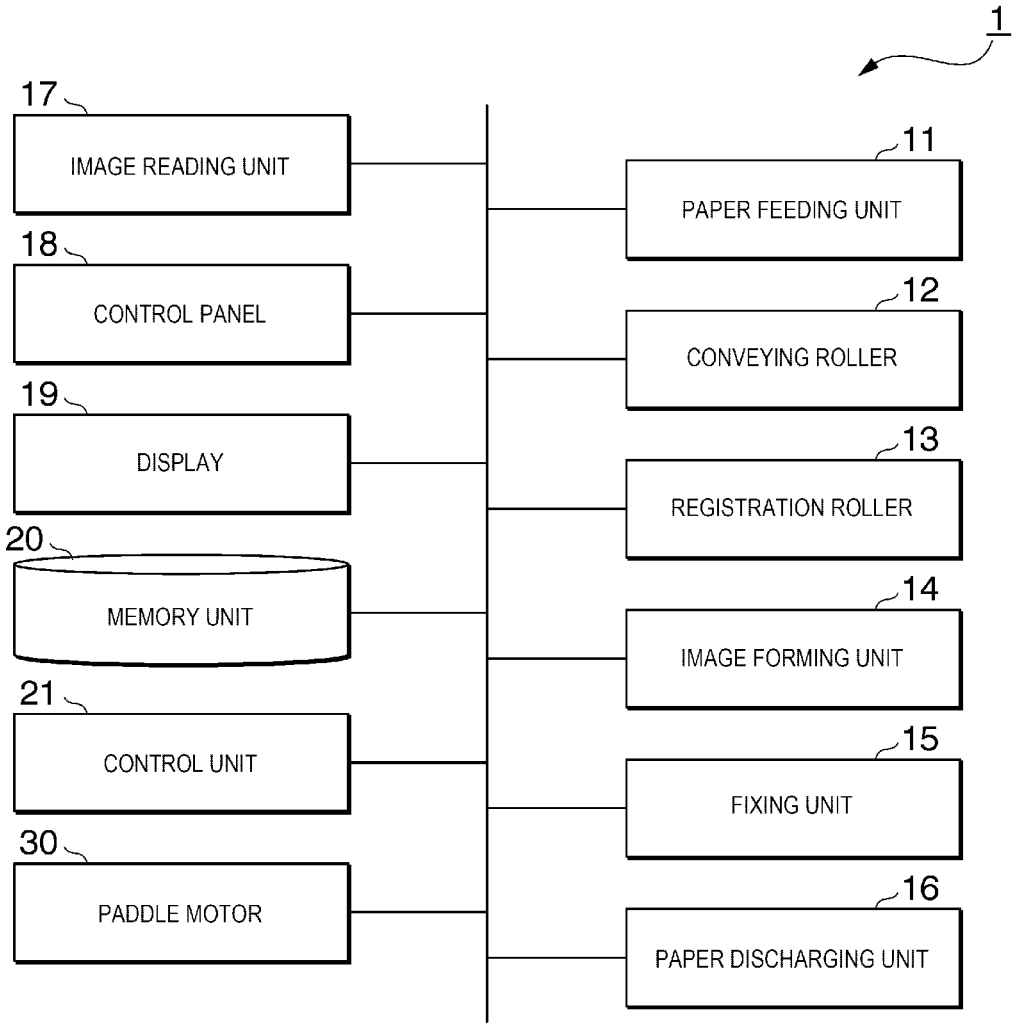
FIG. 2 is a hardware block diagram of the image forming apparatus 1.

Hereinafter, an image forming apparatus and a control method according to an embodiment will be described with reference to the drawings. FIG. 1 is a diagram showing a configuration example of an image forming apparatus 1 according to the embodiment. FIG. 2 is a hardware block diagram of the image forming apparatus 1 according to the embodiment. First, the image forming apparatus 1 will be described with reference to FIGS. 1 and 2.

The image forming apparatus 1 includes a paper feeding unit 11, a plurality of conveying rollers 12, a registration roller 13, an image forming unit 14, a fixing unit 15, a paper discharging unit 16, an image reading unit 17, a control panel 18, a display 19, a memory unit 20, a control unit 21, and a paddle motor 30. The image forming apparatus 1 forms an image on a sheet using a developer such as a toner. The sheet is, for example, paper or label paper. The sheet may be any sheet insofar as the image forming apparatus 1 can form an image on a surface thereof.

The paper feeding unit 11 includes a paper feeding cassette 111 and a paper feeding roller 112. The paper feeding cassette 111 accommodates one or a plurality of sheets. The paper feeding roller 112 rotates to pick up one sheet accommodated in the paper feeding cassette 111, and sends the picked-up sheet to a conveyance path 110.

The conveyance path 110 for conveying a sheet, which is an image forming target, is provided inside the image forming apparatus 1. The conveyance path 110 is formed by providing the plurality of conveying rollers 12 in a space through which the sheet can pass. The conveying rollers 12 rotate as a motor drives, and convey the sheet positioned on the conveyance path 110.

The registration roller 13 is provided in the middle of the conveyance path 110. The registration roller 13 is generally provided in front of a transfer unit of the image forming unit 14. The sheet conveyed on the conveyance path 110 abuts against the registration roller 13 that is not rotating to correct the inclination of the sheet. After then, when the registration roller 13 rotates, the sheet whose inclination is corrected enters the image forming unit 14.

The image forming unit 14 forms an image on the sheet conveyed along the conveyance path 110 based on image information generated by the image reading unit 17 or the received image information. The image forming unit 14 includes, for example, a developer and a transferrer. The image forming unit 14 forms an image, for example, through the following process. The developer of the image forming unit 14 forms an electrostatic latent image on a photoconductive drum based on the image information. The developer of the image forming unit 14 forms a visible image by attaching a toner to the electrostatic latent image. The transferrer of the image forming unit 14 transfers the visible image onto the sheet.

The fixing unit 15 heats and pressurizes the sheet to fix the visible image on the sheet.

The paper discharging unit 16 includes a paper discharge tray 161. The sheet on which the visible image is fixed is discharged to the paper discharging unit 16. For example, the sheet transported along the conveyance path 110 may be biased by the conveying rollers 12 and be discharged onto the paper discharge tray 161.

The image reading unit 17 is, for example, a scanner. The image reading unit 17 reads the image information, which is a reading target, based on the brightness and darkness of light. The image reading unit 17 records the read image information. The recorded image information may be stored in the memory unit 20 of the image forming apparatus 1 or may be transmitted to another information processing apparatus via a network. The recorded image information may be formed as an image on the sheet by the image forming unit 14.

The control panel 18 has a plurality of buttons. The control panel 18 receives user operation. The control panel 18 outputs a signal in response to operation performed by a user to the control unit 21 of the image forming apparatus 1. The display 19 is an image display device such as a liquid crystal display and an organic electroluminescence (EL) display. The display 19 displays various types of information related to the image forming apparatus 1. The control panel 18 and the display 19 may be configured as an integrated touch panel.

The memory unit 20 is configured using a memory device such as a magnetic hard disk device and a semiconductor memory device. The memory unit 20 stores data which is necessary when the image forming apparatus 1 operates. The memory unit 20 may temporarily store or save data of an image formed by the image forming apparatus 1.

The control unit 21 is configured using a processor, such as a central processing unit (CPU), and a memory. The control unit 21 reads and executes a program stored in advance in the memory unit 20. The control unit 21 controls an operation of each device included in the image forming apparatus 1. The control unit 21 controls the operation of the image forming apparatus 1 in response to user operation performed on the control panel 18.

The paddle motor 30 is driven under the control of the control unit 21. The paddle motor 30 rotates a stirring paddle to be described later.

Figure 3:
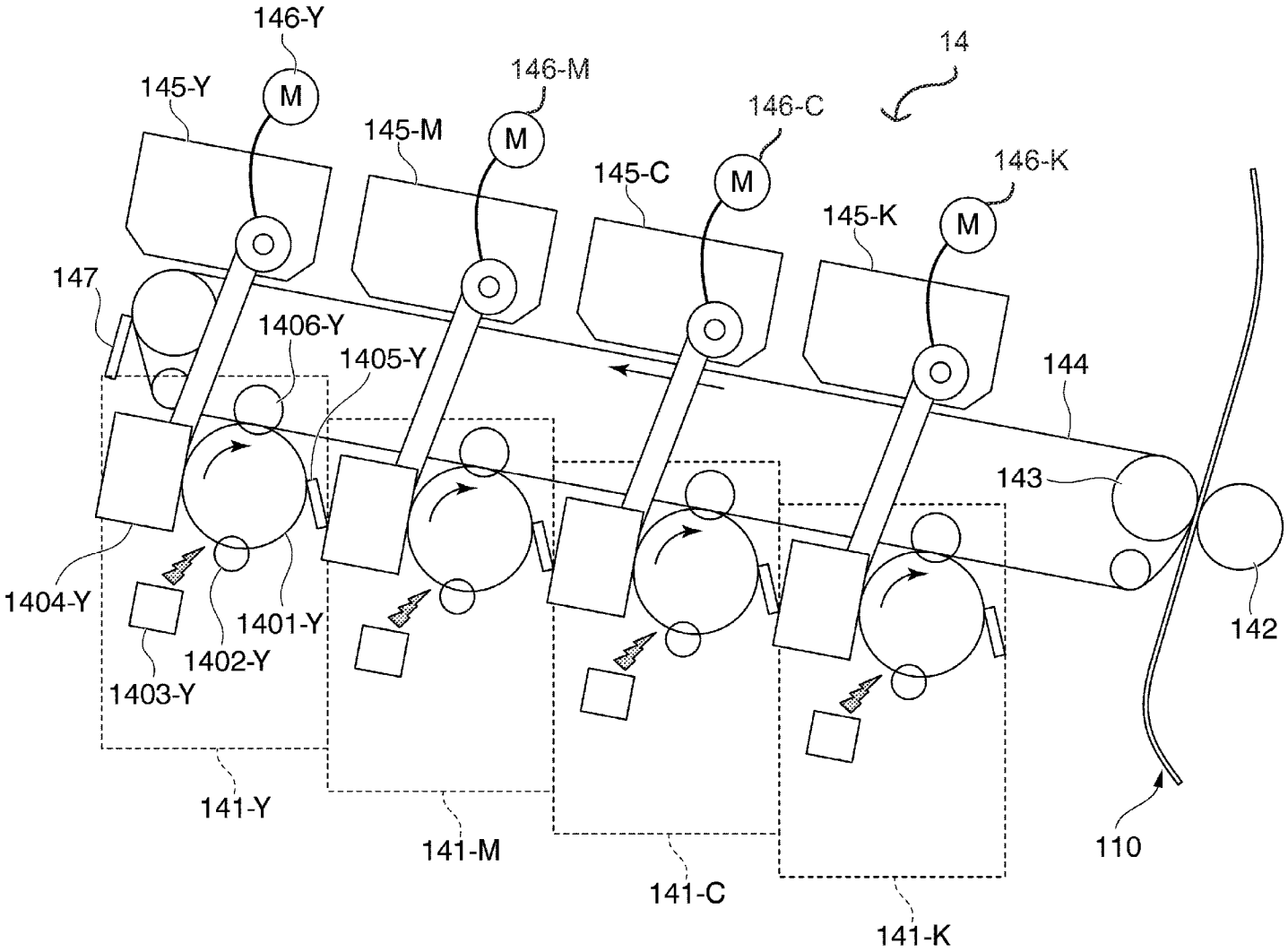
FIG. 3 is a diagram showing a configuration example of an image forming unit 14.

FIG. 3 is a diagram showing a configuration example of the image forming unit 14. The image forming unit 14 includes one or a plurality of process units 141 (141-Y, 141-M, 141-C, 141-K), a secondary transfer roller 142, a secondary transfer facing roller 143, an intermediate transfer belt 144, one or a plurality of toner cartridges 145 (145-Y, 145-M, 145-C, 145-K), one or a plurality of replenishment motors 146 (146-Y, 146-M, 146-C, 146-K), and a transfer cleaner 147. The process unit 141, the toner cartridge 145, and the replenishment motor 146 are provided for each type of toner. In the example of FIG. 3, types of toners include yellow (Y), magenta (M), cyan (C), and black (K). As a type of toner, a toner different from the four toners may be used. For example, a decolorable toner, a fluorescent color toner, and a decorative toner may be used. In FIG. 3, each functional unit corresponding to a toner having each color is distinguished by each of reference symbols "Y", "M", "C", and "K". For example, 141-Y represents the process unit 141 for yellow.

Each process unit 141 forms a toner image on the intermediate transfer belt 144 which is an endless belt. Each process unit 141 includes a photoconductive drum 1401, a charger 1402, an exposure device 1403, a developing device 1404, a photoconductor cleaner 1405, and a primary transfer roller 1406. The process units 141 have the same configuration for Y, M, C, and K, and are provided for four colors.

The photoconductive drum 1401 generates an electrostatic latent image on a surface thereof. The photoconductive drum 1401 is an image carrier. The photoconductive drum 1401 is, for example, a cylindrical drum. The photoconductive drum 1401 has a photoconductor substance on an outer circumferential surface thereof, and has a property of discharging static electricity only in a portion irradiated with light.

The charger 1402 charges the surface of the photoconductive drum 1401 with static electricity. The charger 1402 is, for example, a needle electrode.

The exposure device 1403 forms an electrostatic latent image of an image to be formed on the surface of the photoconductive drum 1401. The exposure device 1403 is, for example, a laser irradiation device.

The developing device 1404 supplies a toner to the surface of the photoconductive drum 1401 and develops the electrostatic latent image with the toner.

The photoconductor cleaner 1405 removes a residual toner on the photoconductive drum 1401. The removed toner is collected as a waste toner in a waste toner box.

The primary transfer roller 1406 transfers the electrostatic latent image developed on the surface of the photoconductive drum 1401 to the intermediate transfer belt 144.

The secondary transfer roller 142 transfers a toner image on the intermediate transfer belt 144 onto the sheet.

The secondary transfer facing roller 143 is at a position facing the secondary transfer roller 142 with the intermediate transfer belt 144 sandwiched therebetween. The secondary transfer facing roller 143 conveys the sheet on which the image is transferred with the sheet sandwiched between the secondary transfer facing roller and the secondary transfer roller 142.

The secondary transfer roller 142 and the secondary transfer facing roller 143 which are described above are provided on one side in a longitudinal direction of the intermediate transfer belt 144. The transfer cleaner 147 is provided on the other side in the longitudinal direction of the intermediate transfer belt 144. The transfer cleaner 147 removes a residual toner on the intermediate transfer belt 144. The toner removed by the transfer cleaner 147 is collected as a waste toner in the waste toner box.

The process unit 141 is provided with the toner cartridge 145 filled with each type of toner.

When driven, the replenishment motor 146 rotates a rotary stirring member (not shown) in the toner cartridge 145. In response to the rotation of the rotary stirring member, a toner in the toner cartridge 145 moves and drops to the developing device 1404 via a tube. Through such an operation, the developing device 1404 is replenished with the toner in the toner cartridge 145.

Figure 4:
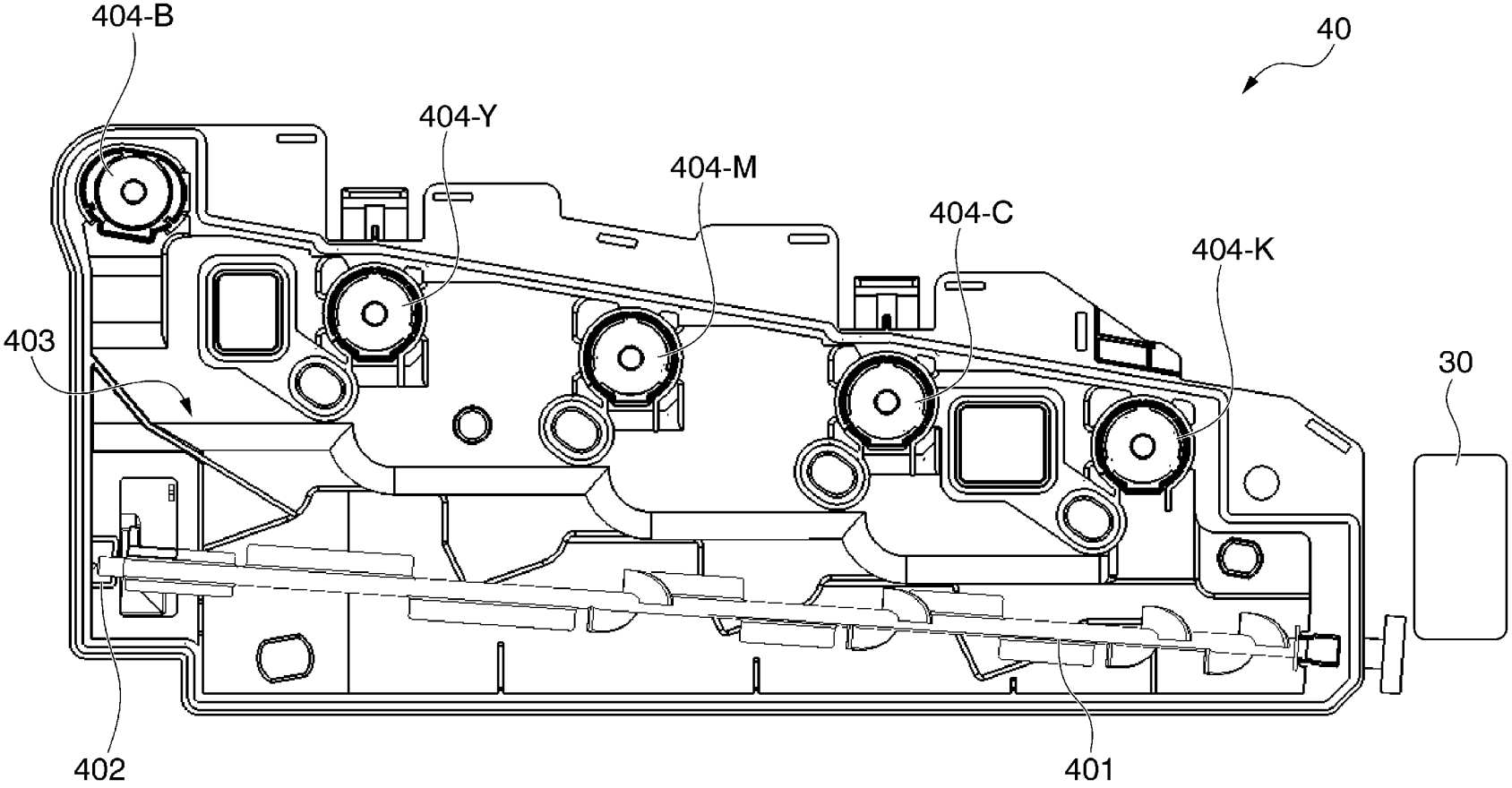
FIG. 4 is a view illustrating a configuration example of a waste toner box 40.

FIG. 4 is a view illustrating a configuration example of a waste toner box 40. The waste toner box 40 is configured to be attachable and detachable to and from the image forming apparatus 1. The waste toner box 40 is a specific example of a waste toner collection container. The waste toner box 40 includes a stirring paddle 401, a detection unit 402, a containing unit 403, and a plurality of waste toner introduction ports 404 (404-B, 404-Y, 404-M, 404-C, 404-K).

By mounting the waste toner box 40 on the image forming apparatus 1, a gear connected to the stirring paddle 401 and the paddle motor 30 are connected to each other. The stirring paddle 401 rotates in response to the driving of the paddle motor 30. As the stirring paddle 401 rotates, a waste toner in the waste toner box 40 is sent in a detection unit 402 direction, and a height thereof is substantially levelled.

The detection unit 402 detects a waste toner that has reached a predetermined height. For example, as the waste toner moves from the waste toner introduction ports 404 into the waste toner box 40, the amount of the waste toner in the waste toner box 40 increases. Along with this increase, the amount of the waste toner near the detection unit 402 also increases. As the waste toner near the detection unit 402 accumulates, a height thereof also increases. When the height of the waste toner exceeds a predetermined threshold, the waste toner is detected by the detection unit 402. The detection unit 402 outputs waste toner detection results to the control unit 21.

The containing unit 403 is a space in the waste toner box 40, which is formed by a wall surface and a bottom surface of the waste toner box. The containing unit 403 contains a waste toner.

Each waste toner introduction port 404 is an opening portion for introducing a waste toner generated in the image forming apparatus 1 into the containing unit 403 in the waste toner box 40. The waste toner introduction port 404 is provided, for example, for each cleaner of the image forming unit 14. Specifically, the waste toner introduction port 404 may be provided individually for the transfer cleaner 147 and the photoconductor cleaner 1405 of each photoconductor. In the specific example of FIG. 4, a waste toner generated by the transfer cleaner 147 moves into the waste toner box 40 from a waste toner introduction port 404-B. A waste toner generated by a photoconductor cleaner 1405-Y for yellow moves into the waste toner box 40 from a waste toner introduction port 404-Y. The same applies to waste toner introduction ports 404-M, 404-C, and 404-K.

Next, control of the paddle motor 30 by the control unit 21 during image formation by the image forming apparatus 1 will be described. The control unit 21 counts the amount of a toner replenished from each toner cartridge 145 to the developing device 1404 (replenishment amount) for each type of toner. In the embodiment, a time for which the replenishment motor 146 is driven is counted as a value indicating the replenishment amount. As a value indicating the replenishment amount, the number of rotations of the replenishment motor 146 may be counted, or another value may be used. Hereinafter, a value counted as a value indicating the replenishment amount will be referred to as a "count value".

When a count value is acquired, the control unit 21 acquires a coefficient corresponding to the type of toner whose count value is obtained. A count value corresponding to the type of toner may be stored in the memory unit 20 in advance. The control unit 21 corrects the obtained count value using the coefficient corresponding to the type of toner. The higher the coefficient value, the higher a correction value obtained. Then, the control unit 21 updates a cumulative count value using the corrected count value. For example, the control unit 21 may update the cumulative count value before update by adding the corrected count value thereto. The cumulative count value is a value used in common regardless of the type of toner.

A coefficient for each type of toner is set based on a predetermined criterion related to a toner. For example, the coefficient may be set according to a position of the waste toner introduction port 404. Specifically, a higher coefficient may be set as the height of the position of the waste toner introduction port 404 is lower. This is because as the height of the position of the waste toner introduction port 404 is lower, there is a possibility that a pile of waste toners reaches the height of the waste toner introduction port 404 with a smaller amount of waste toner. By setting such a coefficient, the stirring paddle 401 is rotated in accordance with a toner near the position of the waste toner introduction port 404 whose height is lower, and the pile of waste toners is levelled. Accordingly, it is possible to effectively prevent the pile of waste toners from reaching the waste toner introduction port 404 and hindering the introduction of a waste toner.

For example, the coefficient may be set according to whether or not the type of toner is a toner that is used in combination with another type of toner on the intermediate transfer belt 144. Specifically, if a toner is used in combination with another type of toner on the intermediate transfer belt 144, a higher coefficient may be set compared to a toner that is not used in combination. As specific examples of the toner used in combination with another type of toner, there are a plurality of toners (C, M, and Y) used in color printing. As a specific example of the toner that is not used in combination, there is a toner (K) used in monochrome printing. If a toner is used in combination with another type of toner, there is a possibility that reverse transfer occurs. If reverse transfer occurs, even another type of toner is introduced from the waste toner introduction port 404 as a waste toner, and thus the amount of the waste toner introduced from the waste toner introduction port 404 increases. For this reason, there is a possibility that a pile of waste toners reaches the height of the waste toner introduction port 404 with a smaller replenishment amount. By setting such a coefficient, the stirring paddle 401 is rotated in accordance with a toner used in combination with another type of toner, and the pile of waste toners is levelled. Accordingly, it is possible to effectively prevent the pile of waste toners from reaching the waste toner introduction port 404 and hindering the introduction of the waste toner. On the other hand, by setting the coefficient of the toner that is not used in combination relatively low, it is possible to prevent the waste toner from being sent to the detection unit 402 proactively and being detected early.

For example, if the type of toner is a toner that is used in combination with another type of toner on the intermediate transfer belt 144, a higher coefficient may be set as the toner is positioned more downstream on the intermediate transfer belt 144. This is because reverse transfer is likely to occur as the toner is positioned more downstream, and the amount of a waste toner caused by reverse transfer increases.

For example, the coefficient may be set according to whether or not the photoconductive drum 1401 abuts against the intermediate transfer belt 144 during standby. Specifically, a low coefficient may be set for a toner correlated with the photoconductive drum 1401 abutting against the intermediate transfer belt 144 during standby (hereinafter referred to as an "abutting toner"), compared to a toner correlated with the photoconductive drum 1401 that does not abut against the intermediate transfer belt 144 during standby (hereinafter referred to as a "separation toner"). In the case of the abutting toner, between standby and image formation, a position change between the photoconductive drum 1401 and the intermediate transfer belt 144 does not occur. For this reason, a waste toner is unlikely to be generated. On the other hand, in the case of the separation toner, between standby and image formation, a position change occurs since the toner abuts against the photoconductive drum 1401 and the intermediate transfer belt 144 therebetween. At such an abutting timing, there is a possibility that a waste toner is generated. Therefore, there is a possibility that the separation toner causes a larger amount of waste toner compared to the abutting toner. Based on such circumstances, a higher coefficient is set for the separation toner, and thereby it is possible to level the waste toner more appropriately.

Based on the circumstances described above, such coefficients below may be set, for example, for the configurations shown in FIGS. 3 and 4. For example, for each type of toner, the correction is performed once for a count of 50.

Coefficient for K: 1.0 time

Coefficient for C: 1.8 times

Coefficient for M: 1.6 times

Coefficient for Y: 1.5 times

For example, in a situation where the cumulative count value is obtained as 50+50+50+50=200 counts in the related art, 50×1.0+50×1.8+50×1.6+50×1.5=295 counts are obtained as the cumulative count value in the embodiment. For this reason, when such color printing is performed, the stirring paddle 401 rotates at an earlier timing. On the other hand, when monochrome printing is performed, in a situation where the cumulative count value is obtained as 50 counts in the related art, the cumulative count value is obtained as 50 counts also in the embodiment. As described above, if the coefficient for K is 1.0 time, there is no difference in the cumulative count value between the related art and the embodiment in the case of monochrome printing. Therefore, in the case of monochrome printing, the stirring paddle 401 can be prevented from rotating needlessly early.

Figure 5:
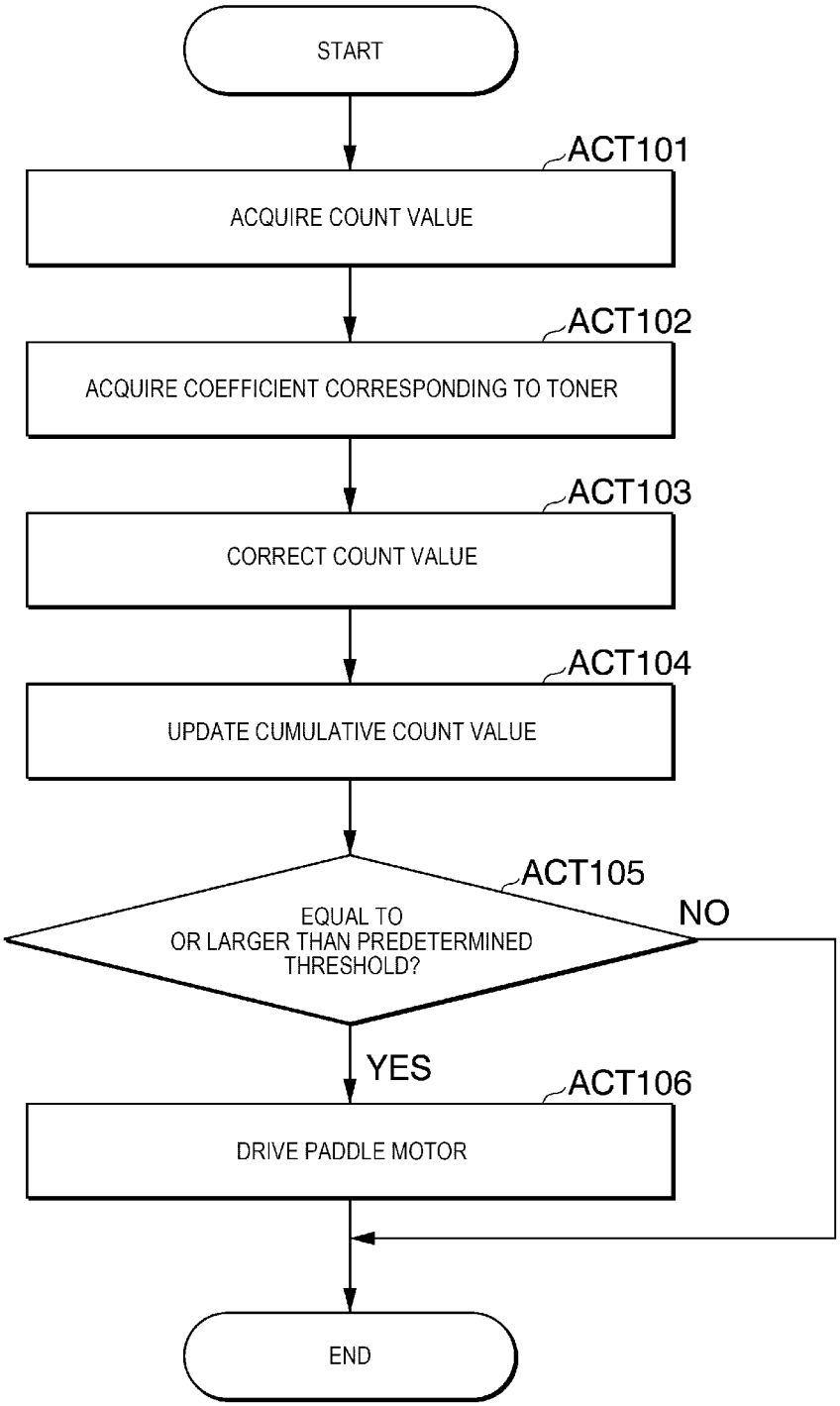
FIG. 5 is a flowchart showing a specific example of flow of operations of the image forming apparatus 1.

FIG. 5 is a flowchart showing a specific example of the flow of operations of the image forming apparatus 1 according to the embodiment. If a predetermined criterion indicating that the amount of a toner in the developing device 1404 is small is satisfied, the control unit 21 drives the replenishment motor 146 corresponding to the type of toner that satisfies the criterion. In response to the driving of the replenishment motor 146, the developing device 1404 whose amount of toner is small is replenished with the toner. The control unit 21 acquires a count value in response to the driving of the replenishment motor 146 (ACT 101). In addition, the control unit 21 acquires a coefficient corresponding to the toner replenished (ACT 102). The control unit 21 corrects the count value using the acquired coefficient (ACT 103). The control unit 21 updates a cumulative count value using the corrected count value (ACT 104). The control unit 21 determines whether or not the updated cumulative count value is equal to or larger than a predetermined threshold (stirring threshold) (ACT 105). If the updated cumulative count value is less than the stirring threshold (ACT 105-NO), the process ends as it is. On the other hand, if the updated cumulative count value is equal to or larger than the predetermined stirring threshold (ACT 105—YES), the control unit 21 drives the paddle motor 30 to rotate the stirring paddle 401 (ACT 106).

With this configuration, it is possible to efficiently collect a waste toner in the waste toner collection container (waste toner box 40). Specifically, a coefficient is determined for each type of toner, and a count value is corrected using the coefficient to obtain a count value corresponding to the type of toner. For this reason, it is possible to control the rotation of the stirring paddle 401 according to characteristics of the accumulation of a waste toner corresponding to the type of toner.

Although description is given that the correction is performed once for a count of 50 for each type of toner in the example, the invention is not limited thereto. For example, counting is performed based on a time for which the replenishment motor 146 is turned on (for example, one count for every 12 ms), and the counting is stopped when the replenishment motor 146 is turned off. Correction may be performed by multiplying the count value obtained at this time by a coefficient.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the coefficient may be set and changed by a manager of the image forming apparatus 1 or a person who performs maintenance.

What is claimed is:

1. An image forming apparatus, comprising:

an image forming component configured to form a toner image on a sheet using a toner replenished from a toner cartridge containing the toner;

a waste toner collection container configured to contain a waste toner generated in the image forming component;

a paddle motor configured to rotate a stirring paddle provided in the waste toner collection container;

a memory component configured to store a coefficient for a plurality of types of toner; and a controller configured to acquire a count value, which is related to a replenishment amount, when the image forming component is replenished with the toner from the toner cartridge, to correct the count value with the coefficient corresponding to a type of toner, to update a cumulative count value with the corrected count value, and to drive the paddle motor according to the updated cumulative count value.

2. The image forming apparatus according to claim 1, wherein the coefficient is determined according to a position of a waste toner introduction port having an opening portion, through which the toner is introduced from the image forming component to the waste toner collection container.

3. The image forming apparatus according to claim 1, wherein the coefficient is determined according to a position of a developing device using the toner.

4. The image forming apparatus according to claim 1, wherein the coefficient is determined according to whether or not the toner is a toner used in combination with another type of toner.

5. The image forming apparatus according to claim 1, wherein the plurality of types of toner comprise at least one of yellow toner, magenta toner, cyan toner, and black toner.

6. The image forming apparatus according to claim 1, wherein the plurality of types of toner comprise at least one of a decolorable toner, a colorable toner, a fluorescent color toner, and a decorative toner.

7. The image forming apparatus according to claim 1, wherein the waste toner collection container is further configured to be attachable and detachable to/from the image forming apparatus.

8. The image forming apparatus according to claim 1, wherein the waste toner collection container comprises a detector to detect a level of toner within the waste toner collection container.

9. The image forming apparatus according to claim 1, wherein the waste toner collection container comprises a plurality of waste toner introduction ports.

10. A control method for an image forming apparatus including an image forming component configured to form a toner image on a sheet using a toner replenished from a toner cartridge containing the toner, a waste toner collection container configured to contain a waste toner generated in the image forming component, a paddle motor configured to rotate a stirring paddle provided in the waste toner collection container, and a memory component configured to store a coefficient for a plurality of types of toner, the method comprising:

acquiring a count value, which is related to a replenishment amount, when the image forming component is replenished with the toner from the toner cartridge;

correcting the count value with the coefficient corresponding to a type of toner;

updating a cumulative count value with the corrected count value; and driving the paddle motor according to the updated cumulative count value.

11. The method according to claim 10, further comprising:

determining the coefficient according to a position of a waste toner introduction port having an opening portion, through which the toner is introduced from the image forming component to the waste toner collection container.

12. The method according to claim 10, further comprising:

determining the coefficient according to a position of a developing device using the toner.

13. The method according to claim 10, further comprising:

determining the coefficient according to whether or not the toner is a toner used in combination with another type of toner.

14. The method according to claim 10, further comprising:

detecting a level of toner within the waste toner collection container.

15. A toner processing apparatus, comprising:

a waste toner collection container configured to contain a waste toner generated from an image forming component;

a paddle motor configured to rotate a stirring paddle provided in the waste toner collection container;

a memory component configured to store a coefficient for a plurality of types of toner; and a controller configured to acquire a count value, which is related to a replenishment amount, when the image forming component is replenished with a toner from a toner cartridge, to correct the count value with the coefficient corresponding to a type of toner, to update a cumulative count value with the corrected count value, and to drive the paddle motor according to the updated cumulative count value.

16. The toner processing apparatus according to claim 15, wherein the coefficient is determined according to a position of a waste toner introduction port having an opening portion, through which the toner is introduced from the image forming component to the waste toner collection container.

17. The toner processing apparatus according to claim 15, wherein the coefficient is determined according to a position of a developing device using the toner.

18. The toner processing apparatus according to claim 15, wherein the coefficient is determined according to whether or not the toner is a toner used in combination with another type of toner.

19. The toner processing apparatus according to claim 15, wherein the plurality of types of toner comprise at least one of yellow toner, magenta toner, cyan toner, black toner, a decolorable toner, a colorable toner, a fluorescent color toner, and a decorative toner.

20. The toner processing apparatus according to claim 15, wherein the waste toner collection container comprises a plurality of waste toner introduction ports.

* * * * *